US006533895B1

(12) United States Patent
Doelle et al.

(10) Patent No.: US 6,533,895 B1
(45) Date of Patent: Mar. 18, 2003

(54) APPARATUS AND METHOD FOR CHEMICALLY LOADING FIBERS IN A FIBER SUSPENSION

(75) Inventors: Klaus Doelle, Appleton, WI (US); Oliver U. Heise, Menasha, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/512,501

(22) Filed: Feb. 24, 2000

(51) Int. Cl.[7] ..... D21H 17/64

(52) U.S. Cl. ..... 162/9; 162/100; 162/181.2; 162/182; 162/183

(58) Field of Search ..... 162/9, 181.2, 182, 162/183, 100

(56) References Cited

U.S. PATENT DOCUMENTS

| | | | | |
|---|---|---|---|---|
| 4,927,618 A | | 5/1990 | Mathur et al. | 423/432 |
| 4,980,395 A | | 12/1990 | Mathur et al. | 523/200 |
| 5,096,539 A | * | 3/1992 | Allan | 162/9 |
| 5,120,521 A | | 6/1992 | Ebinuma et al. | 423/432 |
| 5,223,090 A | | 6/1993 | Klungness et al. | 162/9 |
| 5,332,564 A | | 7/1994 | Chapnerkar et al. | 423/432 |
| 5,364,610 A | | 11/1994 | Merris, Jr. | 423/432 |
| RE35,460 E | * | 2/1997 | Klungness et al. | 162/9 |
| 5,665,205 A | * | 9/1997 | Srivatsa et al. | 162/9 |
| 5,679,220 A | * | 10/1997 | Matthew et al. | 162/9 |

FOREIGN PATENT DOCUMENTS

| | | | |
|---|---|---|---|
| EP | 0 179 597 | 4/1986 | C01F/11/18 |
| EP | 0 799 797 BA | 10/1997 | C01F/11/18 |

* cited by examiner

*Primary Examiner*—Peter Chin
(74) *Attorney, Agent, or Firm*—Taylor & Aust, P.C.

(57) ABSTRACT

A fiber loading apparatus continuously loads fibers in a fiber suspension with a chemical compound. A pulper has an inner chamber, a shear imparting device within the inner chamber, an inlet and an outlet. The pulper inlet receives a fiber suspension at a consistency of between 20 and 30%. The shear imparting device, which may be configured as a rotor, imparts high shear forces to the fiber suspension. A fluffer includes an inner chamber, an inlet and an outlet. The fluffer inlet is connected with the pulper outlet. A reactor includes an inner chamber, an inlet and an outlet. The reactor inlet is connected with the fluffer outlet. A gas supply is connected with the fluffer inner chamber and/or reactor inner chamber. The gas supply supplies and pressurizes the fluffer inner chamber and/or reactor inner chamber with a gas, such as carbon dioxide or ozone, acting as a reactant for the chemical compound to be loaded into fibers of the fiber suspension. A mixing device includes an inner chamber, an inlet, an outlet and a shear imparting device. The mixing device inlet is connected with a reactor outlet for receiving the loaded fiber suspension. The shear imparting device, such as a rotor, is disposed within the inner chamber and imparts lower shear forces to the fiber suspension.

5 Claims, 1 Drawing Sheet

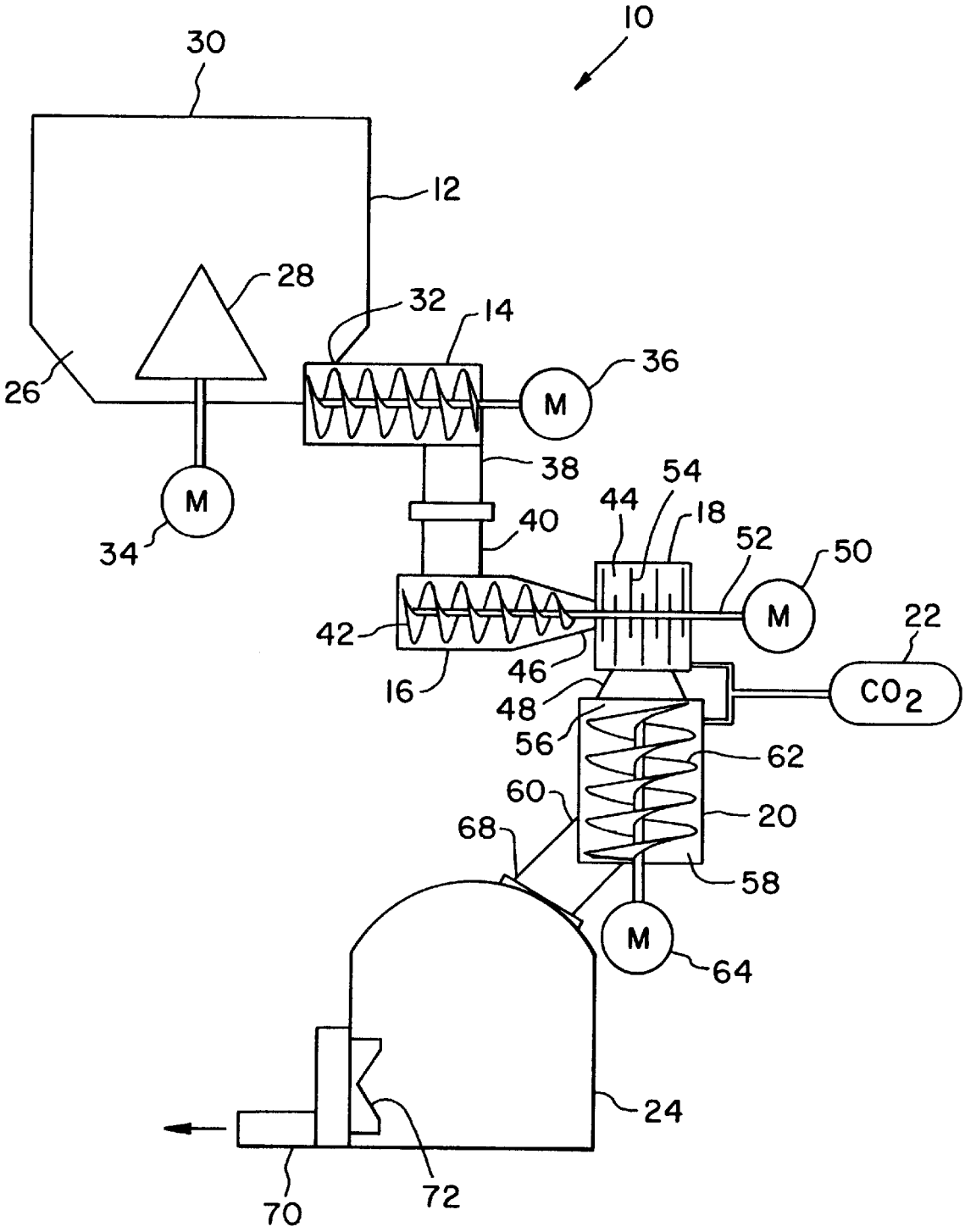
10
30
12
28
32
14
36
26
M
38
54
44
18
52
50
M
34
40
M
22
42
46
16
48
CO2
56
62
60
20
68
58
M
64
24
70
72

APPARATUS AND METHOD FOR CHEMICALLY LOADING FIBERS IN A FIBER SUSPENSION

BACKGROUND OF THE INVENTION

1. Field of the Invention

The present invention relates to an apparatus and method for loading fibers in a fiber suspension for use in a paper-making machine with a chemical compound, and, more particularly, to an apparatus and method for loading fibers in a fiber suspension with calcium carbonate.

2. Description of the Related Art

A paper-making machine receives a fiber suspension including a plurality of fibers, such as wood fibers, which are suspended within an aqueous solution. The water is drained from the fiber suspension and dried in the paper-making machine to increase the fiber content and thereby produce a fiber web as an end product.

The fiber web produced by the paper-making machine typically includes organic wood fibers and inorganic fillers. A known inorganic filler is calcium carbonate, which may be added directly to the fiber suspension (direct loaded calcium carbonate). It is also known to chemically load the fibers within a fiber suspension with calcium carbonate in the lumen and walls of the individual fibers (fiber loaded calcium carbonate). The fiber loaded calcium carbonate increases the strength of the paper compared with a direct loaded calcium carbonate (adding calcium carbonate directly to the fiber suspension) at the same loading (filler) level. This yields an economic advantage in that the filler level of the paper is increased by replacing the more expensive fiber source (wood fibers) with calcium carbonate. The finished paper web has higher strength properties due to the increased filler levels of the calcium carbonate. In contrast, the strength properties of a finished web using direct loaded calcium carbonate is less.

For example, U.S. Pat. No. 5,223,090 (Klungness, et al.) discloses a method for chemically loading a fiber suspension with calcium carbonate. In one described method, calcium oxide or calcium hydroxide is placed within a refiner unit and carbon dioxide is injected into the refiner unit at a specified pressure. The fiber suspension is maintained within the refiner for a predetermined period of time to ensure that a proper chemical reaction and thus proper chemical loading of the fiber suspension occurs. In another described method, a fiber suspension with calcium oxide or calcium hydroxide is introduced into a 20 quart food mixer and carbon dioxide gas is injected into the mixer at a specified pressure. Using either the refiner or the food mixer, both methods utilize a batch processing method for processing only a small amount of the fiber suspension at a time. Because of the large amount of fiber suspension which is required at the wet end of a paper-making machine, a batch process requires that the chemically loaded fiber suspension be transferred to another holding tank for ultimate use in a paper-making machine.

What is needed in the art is an apparatus and a method for chemically loading a fiber suspension for use in a paper-making machine with an adequate output of a chemically loaded fiber suspension which allows commercialization of such a chemical loading process.

SUMMARY OF THE INVENTION

The present invention provides a fiber loading apparatus which effectively loads fibers within a fiber suspension, and which is compactly constructed and arranged to occupy less physical space.

The invention comprises, in one form thereof, a fiber loading apparatus for continuously loading fibers in a fiber suspension with a chemical compound. A pulper has an inner chamber, a shear imparting device within the inner chamber, an inlet and an outlet. The pulper inlet receives a fiber suspension at a consistency of between 20 and 30%. The shear imparting device, which may be configured as a rotor, imparts high shear forces to the fiber suspension. A fluffer includes an inner chamber, an inlet and an outlet. The fluffer inlet is connected with the pulper outlet. A reactor includes an inner chamber, an inlet and an outlet. The reactor inlet is connected with the fluffer outlet. A gas supply is connected with the fluffer inner chamber and/or reactor inner chamber. The gas supply supplies and pressurizes the fluffer inner chamber and/or reactor inner chamber with a gas, such as carbon dioxide or ozone, acting as a reactant for the chemical compound to be loaded into fibers of the fiber suspension. A mixing device includes an inner chamber, an inlet, an outlet and a shear imparting device. The mixing device inlet is connected with a reactor outlet for receiving the loaded fiber suspension. The shear imparting device, such as a rotor, is disposed within the inner chamber and imparts lower shear forces to the fiber suspension.

An advantage of the present invention is that the fiber loading of the fiber suspension takes place as a continuous process, thereby providing output quantities of loaded fiber suspension sufficient for use in a paper-making machine.

Another advantage is that variables such as flow rate, temperature and pressure which affect the fiber loading process can be accommodated and varied.

Yet another advantage is that the fiber loading apparatus is compactly constructed and arranged to occupy less physical space.

BRIEF DESCRIPTION OF THE DRAWING

The above-mentioned and other features and advantages of this invention, and the manner of attaining them, will become more apparent and the invention will be better understood by reference to the following description of an embodiment of the invention taken in conjunction with the accompanying drawing, which is a schematic illustration of an embodiment of a fiber loading apparatus of the present invention for loading fibers in a fiber suspension with a chemical compound. The exemplification set out herein illustrates one preferred embodiment of the invention, in one form, and such exemplification is not to be construed as limiting the scope of the invention in any manner.

DETAILED DESCRIPTION OF THE INVENTION

Referring now to the drawing, there is shown a schematic representation of a fiber loading apparatus 10 of the present invention for continuously loading fibers in a fiber suspension with a chemical compound. Fiber loading apparatus 10 generally includes a pulper 12, discharge auger 14, sealing device 16, fluffer 18, reactor 20, gas supply 22 and mixing device 24.

Pulper 12 includes an inner chamber 26, a shear imparting device 28 within inner chamber 26, an inlet 30 and an outlet 32. Inlet 30 receives a fiber suspension at a consistency of between approximately 20 and 30%, and has calcium oxide and/or calcium hydroxide suspended therein. Shear imparting device 28 imparts high shear forces to the fiber suspension to pulp the fiber suspension and at least substantially deflocculate the individual fibers within the fiber suspension. In the embodiment shown, shear imparting device 28 is in the form of a rotor driven by a motor 34.

Discharge auger 14 is coupled with pulper outlet 32, and is rotationally driven by a motor 36. Discharge auger 14 has an outlet 38 which is coupled with an inlet 40 of sealing device 16.

Sealing device 16 fluidly seals fluffer 18 and fluidly separates fluffer 18 from discharge auger 14, while at the same time effectively transporting the fiber suspension from discharge auger 14 to fluffer 18. In the embodiment shown, sealing device 16 includes an auger 42 therein which substantially seals with the radial interior of sealing device 16, thereby substantially sealing fluffer 18.

Fluffer 18 includes an inner chamber 44, inlet 46 and outlet 48. Motor 50 is coupled with and rotationally drives a shaft 52 which extends through inner chamber 44 and is coupled with auger 42. Thus, motor 50 rotationally drives each of shaft 52 and auger 42. Shaft 52 carries a plurality of projections 54 which extend radially therefrom and function to stir or mix the fiber suspension within fluffer 18.

Fluffer 18 is mounted directly on top of reactor 20 and provides a fluffed fiber suspension to reactor 20. More particularly, fluffer outlet 48 is directly connected with inlet 56 of reactor 20. Reactor 20 also includes an inner chamber 58 and outlet 60. Suitable structure, such as an auger 62, is disposed within inner chamber 58 and transports the fiber suspension from inlet 56 to outlet 60. Auger 62 is rotationally driven by motor 64 at a speed which is effective to transport the fiber suspension through reactor 20 at a throughput rate which effectively allows loading of the chemical compound within the fiber suspension. For an example of the details of such a reactor, reference is hereby made to copending U.S. patent application Ser. No. 09/130,176, entitled "APPARATUS AND METHOD FOR CHEMICALLY LOADING FIBERS IN A FIBER SUSPENSION", which is assigned to the Assignee of the present invention and incorporated hereby.

Gas supply 22 is fluidly connected with at least one of fluffer 18 and reactor 20. In the embodiment shown, gas supply 22 is connected with each of fluffer 18 and reactor 20 in a parallel manner. Gas supply 22 thereby supplies and pressurizes each of fluffer 18 and reactor 20 with a gas acting as a reactant for the chemical compound to be loaded into the fibers of the fiber suspension. More particularly, gas supply 22 supplies carbon dioxide ($CO_2$) and/or ozone ($O_3$) to inner chamber 44 of fluffer 18 and inner chamber 58 of reactor 20. For example, if the first chemical reactant added to the fiber suspension within pulper 12 is calcium hydroxide and the gas reactant is carbon dioxide, the chemical process is represented by the chemical equation:

$$Ca(OH)_2+CO_2 \leftrightarrow CaCO_3+H_2O$$

The calcium carbonate produced by the chemical reaction is effectively loaded into the lumen of a substantial portion of the fibers within the fiber suspension by controlling the throughput rate, reaction temperature, pH, etc. associated with the fiber loading process which occurs within reactor 20.

Mixing device 24 includes an inner chamber 66, inlet 68, outlet 70 and shear imparting device 72. Mixing device 24 receives the loaded fiber suspension within inner chamber 66 via inlet 68 which is fluidly connected with outlet 60 of reactor 20. Shear imparting device 72, in the embodiment shown, is in the form of a rotor which imparts low shear forces to the loaded fiber suspension within inner chamber 66, thereby mixing and deflocculating the fiber suspension. The loaded and deflocculated fiber suspension is transported through outlet 70 for further processing, storage and/or use by a paper-making machine (not shown).

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of continuously loading fibers in a fiber suspension with calcium carbonate, comprising the steps of:

introducing a fiber suspension at a consistency of between approximately 10 and 45% and having at least one of calcium oxide and calcium hydroxide therein into a pulper;

pulping the fiber suspension within said pulper;

transporting the pulped fiber suspension from said pulper to an inner chamber of a fluffer;

fluffing the pulped fiber suspension within said fluffer;

transporting the fluffed fiber suspension into a reactor coupled directly with and positioned under said fluffer;

injecting a reactant gas into at least one of said fluffer and said reactor, whereby each of said fluffer and said reactor are pressurized to a predetermined pressure;

loading fibers within the fiber suspension with the chemical compound in said reactor;

transporting the loaded fiber suspension to a mixing device;

pulping the loaded fiber suspension within said mixing device; and discharging the pulped and loaded fiber suspension from said mixing device.

2. The method of claim 1, wherein said injecting step comprises injecting a gas consisting essentially of at least one of carbon dioxide and ozone.

3. The method of claim 1, wherein said injecting step comprises injecting a reactant gas into each of said fluffer and said reactor in a parallel manner.

4. The method of claim 1, wherein said fiber suspension is introduced at a consistency of between approximately 15 and 30 percent.

5. The method of claim 4, wherein said fiber suspension is introduced at a consistency of between approximately 20 and 30%.

* * * * *